United States Patent [19]

Tomlinson

[11] Patent Number: 4,926,805

[45] Date of Patent: May 22, 1990

[54] PUSH ROD TUBE FOR HIGH LIFT ROCKER ARMS

[76] Inventor: Robert A. Tomlinson, 28813 Farmersville, Farmersville, Calif. 93223

[21] Appl. No.: 336,699

[22] Filed: Apr. 12, 1989

[51] Int. Cl.[5] ..... F01L 1/14

[52] U.S. Cl. ..... 123/90.61

[58] Field of Search ..... 123/90.61, 90.62, 90.63, 123/90.64

[56] References Cited

U.S. PATENT DOCUMENTS

| | | | |
|---|---|---|---|
| 1,443,940 | 2/1923 | Anderson | 123/90.62 |
| 1,948,023 | 2/1934 | Church | 123/90.61 |
| 1,948,415 | 2/1934 | Cooper | 123/90.61 |
| 2,743,712 | 5/1956 | Hulsing | 123/90.61 |
| 3,034,488 | 5/1962 | Reiners | 123/90.61 |

FOREIGN PATENT DOCUMENTS

| | | | |
|---|---|---|---|
| 2846944 | 5/1980 | Fed. Rep. of Germany | 123/90.62 |
| 0155516 | 9/1984 | Japan | 123/90.61 |

*Primary Examiner*—Charles J. Myhre
*Assistant Examiner*—Weilun Lo
*Attorney, Agent, or Firm*—Bruce & McCoy

[57] ABSTRACT

A flat four opposed cylinder air cooled Volkswagen engine push rod tube having a fluted upper end to accommodate push rod lateral movement caused by high lift rocker arms.

1 Claim, 2 Drawing Sheets

PUSH ROD TUBE FOR HIGH LIFT ROCKER ARMS

BACKGROUND OF THE INVENTION

1. Field of the Invention

The present invention relates to push rod tubes for automobile engines and more particularly to a push rod tube for a flat four opposed cylinder air cooled Volkswagen engine which utilizes high lift rocker arms for increased volumetric efficiency of the engine.

A problem which occurs in the operation of Volkswagen engines after high lift rocker arms have been installed is that the push rod operating parameters are displaced from the designed operating path and the push rods reciprocate at a location closer to the walls of the push rod tubes than was intended by the original design of the engine. The lateral displacement of the push rods is sufficient that under certain conditions and excursions there can be mechanical interference between the push rods and the side wall of the standard push rod tube.

In order to be able to utilize the high lift rocker arms required for increased engine breathing and volumetric efficiency, it is necessary to provide an adequate clearance between the push rods and the interior wall of the push rod tube at the outer ends thereof in the area proximate the rocker arms where there is a possibility of interference.

2. Description of the Prior Art

A standard push rod tube for a flat four opposed cylinder air cooled Volkswagen engine is illustrated in FIG. 1 of the drawings of this specification. It discloses a push rod tube having a pair of bellows disposed integral to and disposed at opposed ends of the push rod tube and spaced from the ends thereof. In the initial design configuration, the push rod tubes are manufactured slightly longer in length than the length they are designed to assume when they are disposed in operative position between the crankcase and the cylinder heads of the engine.

The push rod tubes are shortened during the installation process by the seating of the cylinder heads onto the engine block. The space loss occurs during the cylinder head tightening operation and the length decrease is accommodated by each of the push rod tube bellows collapsing slightly. This ensures that the gaskets and seals on the ends of the push rod tubes are properly seated and compressed in their respective receptacles to seal out any dirt from penetrating into the engine and to prevent the escape of any internal engine gases and fluids during operation. The push rod tubes are not otherwise held in position by bolts or flanges but are simply held in place in captured relation between the cylinder heads and crankcase by their respective receptacles and seals.

Initial attempts to increase the diameter of the push rod tubes for the purpose of accommodating the resulting push rod lateral movement within the tubes, caused by the installation of high lift rocker arms, has been relatively unsuccessful for several reasons. One of the reasons is that a larger outside diameter bellows would interfere with the cooling fins of the cylinder head. Another reason is that a tube of standard design with a larger outside diameter at the end would not fit into the receptacle provided in the cylinder head.

Thus, it is necessary to provide another solution to the problem of interference between the push rod movement and the internal wall of the push rod tube when high lift rocker arms are utilized in a Volkswagen flat four opposed cylinder air cooled engine other than just increasing the internal diameter of the tube.

SUMMARY OF THE INVENTION

The present invention is a push rod tube for a flat four opposed cylinder air cooled Volkswagen engine which utilizes an elongated push rod tube having a fluted upper end with an increased internal diameter for a portion of the length thereof. The internal diameter of the fluted portion of the tube is everywhere greater than the standard push rod tube with the largest portion of the diameter of the fluted portion being disposed at the outer end of the tube. With the new design of the present invention, it is possible to eliminate the bellows section formerly located at the outer end of the standard push rod tube.

OBJECTS OF THE INVENTION

It is therefore an important object of the present invention to provide a new and novel push rod tube for a flat four opposed cylinder air cooled Volkswagen engine to permit the use of high lift rocker arms in the engine.

It is another object of the present invention to provide a push rod tube for said Volkswagen engine utilizing high lift rocker arms which provides greater clearance between the push rod and the internal wall of the push rod tube at the outer end thereof and eliminates the possibility of mechanical interference between the push rod and the push rod tube.

It is a further object of the present invention to provide a push rod tube for said Volkswagen engine that properly seals with the cylinder heads and crankcase of the engine while utilizing only a single tube shortening accommodation section in said tube.

Other objects and advantages of the present invention will become apparent when the push rod tube of the present invention is considered in conjunction with the accompanying drawings.

DESCRIPTION OF THE PREFERRED EMBODIMENT

Reference is made to the drawings for a description of the preferred embodiment of the present invention wherein like reference numbers represent like elements on corresponding views.

Figure 1:
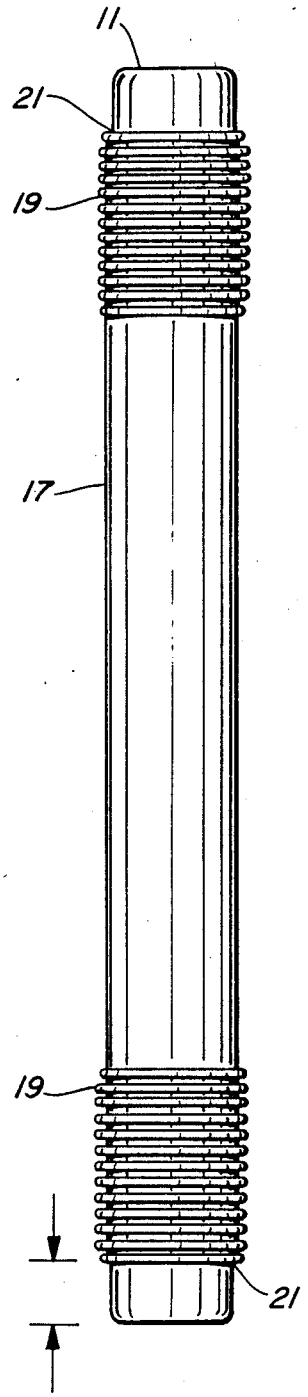
FIG. 1. (PRIOR ART)
FIG. 1 is a side elevation of a standard flat four opposed cylinder air cooled Volkswagen engine push rod tube.
Figure 4:
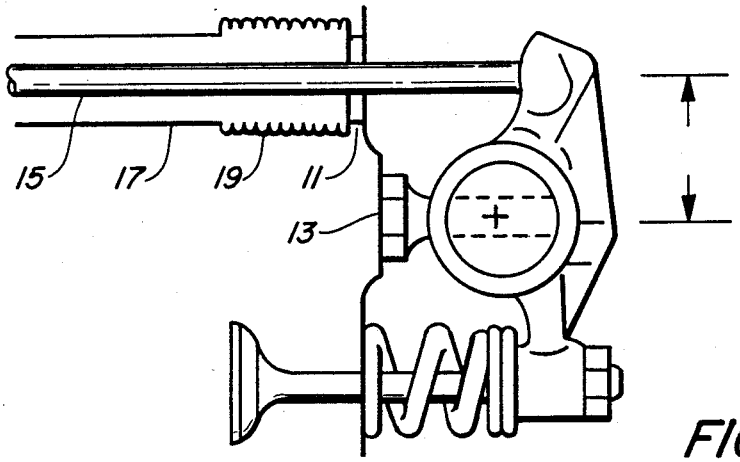
FIG. 4. (PRIOR ART)
FIG. 4 is a side elevation in partial section of the rocker arm and valve and push rod arrangement of a standard flat four opposed cylinder air cooled Volkswagen engine.
Figure 5:
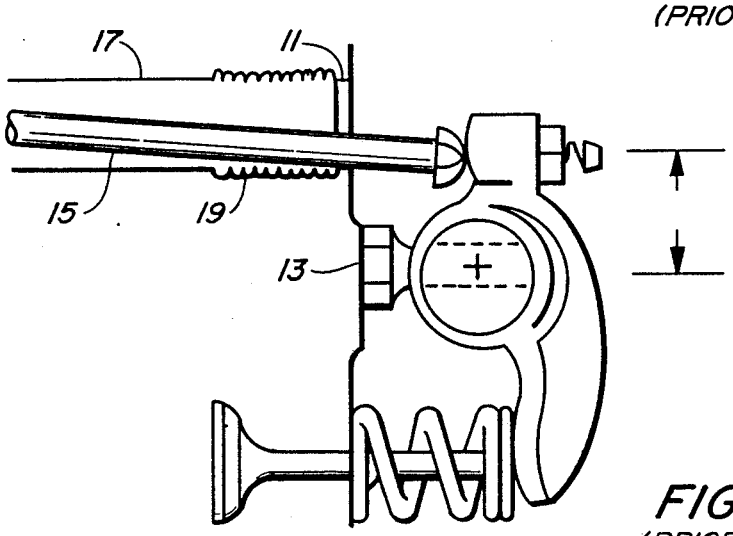
FIG. 5. (PRIOR ART)
FIG. 5 is a side elevation in partial section of the push rod and valve arrangement utilizing a high lift rocker arm for said engine with a standard Volkswagen engine push rod tube.
Figure 6:
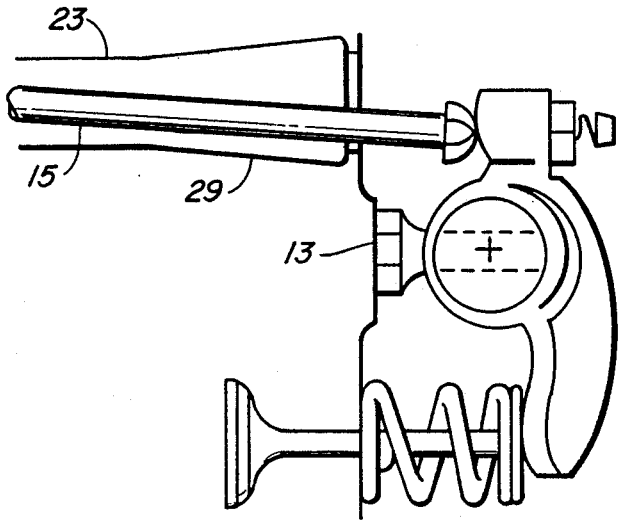
FIG. 6 is a side elevation in partial section of the push rod and valve arrangement utilizing a high lift rocker arm for said Volkswagen engine with the push rod tube of the present invention.

FIG. 1 illustrates a standard push rod tube for a first four opposed cylinder air cooled Volkswagen engine. Both ends are uniform and the push rod tube can be installed either end out. Reference is made to FIG. 4. When installed in an engine, the push rod tubes are disposed in a horizontal orientation with the inner end projecting into and terminating in a receptacle in the crankcase of the engine. Respectively, the outer or top end of the tube 11 is disposed and terminates in a receptacle formed in a cylinder head 13 of the engine. A push rod 15 which actuates a rocker arm is enclosed inside the push rod tube 17 when the engine is assembled.

Compressible neoprene seals (not shown) surround each end of the tube when it is disposed in operative position in the engine and seal the tube to the cylinder heads and crankcase. Bellows sections 19 disposed proximate the opposite ends of the push rod tubes are formed integral thereto and the outer ends thereof 21 function as stops or flanges for the seals to seat against. During assembly of the engine, the ends of the push rod tubes are aligned with receptacles formed in the cylinder heads and the crankcase of the engine. As the cylinder heads are tightened onto the engine block, the push rod tubes are compressed longitudinally between the cylinder heads and the crankcase and forced along with the seals into the respective receptacles. The bellows collapse slightly to accommodate the shortened spacing between the heads and crankcase.

Figure 2:
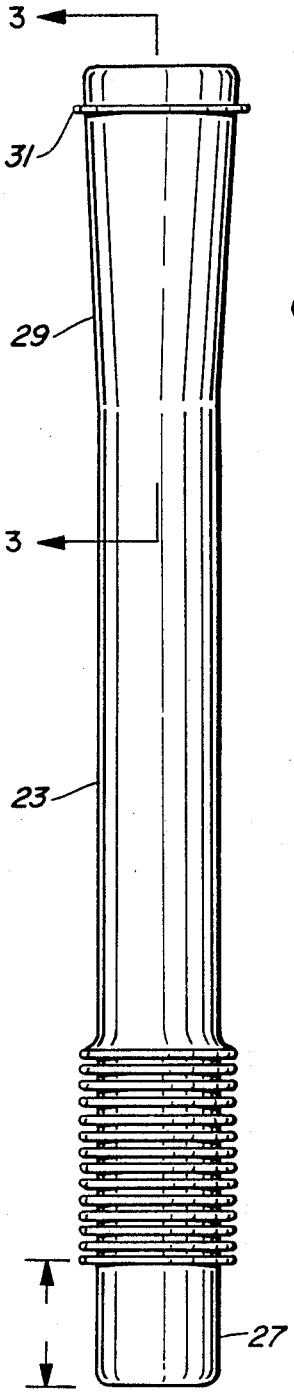
FIG. 2 is a side elevation of the push rod tube of the present invention for said Volkswagen engine utilizing high lift rocker arms.

FIG. 2 discloses the modified push rod tube 23 of the present invention. It is an elongated tube having an accordion section 25 disposed proximate the inner or lower end thereof 27 for permitting the tube to be compressed into place between the cylinder heads and the crankcase with a proper sealing relation. By virtue of the present design, the same internal and external push rod tube dimensions can be maintained at the lower end thereof as a standard one thereby allowing a standard diameter bellows to be utilized in the design. The bellows can be made slightly longer than a standard one to accommodate the required compression without adversely affecting the strength or longitudinal rigidity of the tube.

The outer end 29 of the improved push rod tube of the present invention is fluted with a straight sided partial narrow funnel section. It provides an increased internal diameter for a portion of the length of the tube. The increased internal diameter of the preferred embodiment is everywhere greater than the internal diameter of a standard push rod tube with the largest portion of the increased diameter being disposed at the outer or top end 29 of the tube. The improved tube tapers down to the standard diameter at an intermediate location along the length of the tube. The increased diameter extends for approximately a quarter of the length from the outer end thereof. A flange 31 is disposed proximate the outer end of the tube and surrounds the end of the tube to provide a bearing or restraining surface for the outer rubberized seal which encircles the end of the tube in its operative condition. A customized seal of thinner cross-section fits the improved push rod tube into the standard cylinder head receptacle.

Figure 3:
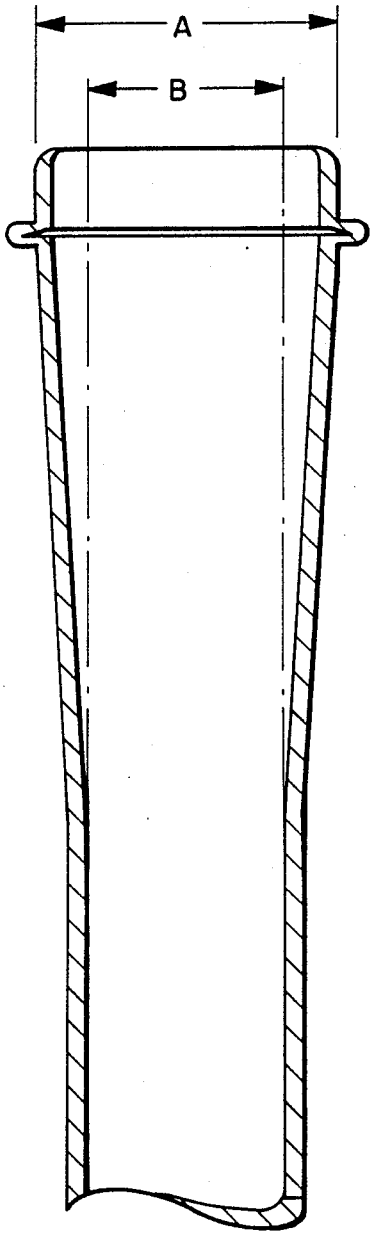
FIG. 3 is a partial cross-sectional of the flared outer end of the push rod tube of the present invention.

The particular dimensions have been determined for use with the improved push rod tube of the present invention. See FIG. 3. The stock internal diameter of a push rod tube is 0.822 inches in diameter at the ends of the tube. The present invention flares to a maximum internal diameter of 0.981 inches (dimension A) at the outer end of the tube. The flare starts increasing in diameter 1.950 inches from the outer end of the tube. The standard tube and the tube of the present invention both have an internal diameter of 0.830 inches in the center of the tube (dimension B). These parameters have been found to be satisfactory for all high lift rocker arms which can be used with flat four opposed cylinder air cooled Volkswagen engines.

ADVANTAGES

The preferred embodiment of the present invention provides the needed internal area required for use with various aftermarket rocker arms; it provides for an improved, easier to install oil seal at the cylinder head; the extended end of the push rod tube at the crankcase end creates a baffle to prevent engine oil from surging into the cylinder head during fast cornering such as experienced during flat track and road racing; and elimination of the accordion pleat bellows at the cylinder head end of the push rod tube eliminates a weak link in the original design. The high temperature created in the cylinder heads (up to 400 degrees), and the placement of the standard bellows just below the pistons and cylinders results in the burning off of protective coatings and exposing the bear metal to the elements thereby allowing penetration of road salts and other corrosive elements into the pleats causing rapid deterioration of that bellows. The accordion pleats at the engine case end of the push rod tube are not subjected to the high and extreme temperature changes as the cylinder head end of the tube and do not cause a problem. Thus, elimination of the weak link bellows increases push rod tube life expectancy.

Thus; it will be seen from the description of the preferred embodiment that all of the objects and advantages of the invention are achieved. While the preferred embodiment of the invention has been described in considerable detail herein, the invention is not to be limited to such details as have been set forth except as may be necessitated by the appended claims.

I claim:

1. A push rod tube for a flat four opposed cylinder air cooled engine comprising an elongated tube having a fluted outer end with straight sides tapering down to an intermediate location along the length of the tube, said tube having an increased internal diameter for a portion of the length thereof in the fluted portion with the largest portion of the diameter being disposed at the outer end of said tube, a flange disposed proximate the outer end of said tube in surrounding relation, and said elongated tube having an inner end opposite said fluted outer end with an accordion section disposed proximate said inner end.

* * * * *